US007128523B2

(12) United States Patent
Aizawa et al.

(10) Patent No.: US 7,128,523 B2
(45) Date of Patent: Oct. 31, 2006

(54) DRAINAGE PUMP AND UNDERWATER BEARING UNIT

(75) Inventors: Kouji Aizawa, Tokyo (JP); Shigeru Kishimoto, Ibaraki (JP); Kaname Takagi, Tokyo (JP); Minoru Iwasaki, Tokyo (JP); Tomohiko Tagawa, Ibaraki (JP)

(73) Assignee: Hitachi Industries Co., Ltd., Tokyo (JP)

( * ) Notice: Subject to any disclaimer, the term of this patent is extended or adjusted under 35 U.S.C. 154(b) by 247 days.

(21) Appl. No.: 10/878,405

(22) Filed: Jun. 29, 2004

(65) Prior Publication Data

US 2005/0089434 A1 Apr. 28, 2005

(30) Foreign Application Priority Data

Oct. 24, 2003 (JP) ..... 2003-364053

(51) Int. Cl.
*F01D 11/00* (2006.01)
*F03B 11/00* (2006.01)
*F04D 29/08* (2006.01)

(52) U.S. Cl. ..... 415/111; 415/216.1; 415/229

(58) Field of Classification Search ..... 384/97, 384/98, 276, 909, 912, 913; 415/216.1, 229, 415/111

See application file for complete search history.

(56) References Cited

U.S. PATENT DOCUMENTS

| | | | | |
|---|---|---|---|---|
| 4,664,595 | A * | 5/1987 | Tsuji et al. | 415/229 |
| 5,700,093 | A * | 12/1997 | Hiramatsu et al. | 384/276 |
| 5,792,717 | A * | 8/1998 | Takayama | 501/88 |
| 6,276,898 | B1 * | 8/2001 | Elliott | 416/162 |
| 6,406,184 | B1 * | 6/2002 | Orndorff et al. | 384/98 |

FOREIGN PATENT DOCUMENTS

| | | |
|---|---|---|
| JP | SHO 62-194919 | 6/1986 |
| JP | 06-147228 | 5/1994 |
| JP | 06-346887 | 12/1994 |
| JP | 10-252758 | 9/1998 |
| JP | 2002-147459 | 5/2002 |

* cited by examiner

*Primary Examiner*—Edward K. Look
*Assistant Examiner*—Devin Hanan
(74) *Attorney, Agent, or Firm*—Crowell & Moring LLP

(57) ABSTRACT

A drainage pump has a pump part in which blades mounted on a rotary shaft are arranged in a pump casing and an underwater bearing unit which uses pumped water mixed with hard particles as a lubricant and has a sliding bearing for journaling the rotary shaft. A portion of the rotary shaft journaled by the sliding bearing is formed of a cemented carbide material and a shaft journaling surface of the sliding bearing is formed of a thermoplastic resin material to be embedded with hard particles.

2 Claims, 2 Drawing Sheets

DRAINAGE PUMP AND UNDERWATER BEARING UNIT

CLAIM OF PRIORITY

The present application claims priority from Japanese application serial no. 2003-364053, filed on Oct. 24, 2003, the content of which is hereby incorporated by reference into this application.

FIELD OF THE INVENTION

The present invention relates to a drainage pump and an underwater bearing unit and, in particular, is suitable for a drainage pump and an underwater bearing unit in which pumped water mixed with hard particles is used as a lubricant.

BACKGROUND OF THE INVENTION

A combination of a rolling bearing provided outside a pump casing and a sliding bearing that is provided in a pumped water path (in a pump casing) and uses pumped water mixed with hard particles as a lubricant has been widely used as a bearing for journaling the main shaft of a horizontal drainage pump.

One of sliding bearings is a ceramic bearing having excellent wear resistance as disclosed in Japanese Unexamined Utility Model Publication No. S62(1987)-194919 (Patent document 1). This ceramic bearing employs an elastic support structure from a viewpoint of avoiding damage caused by local contact. This elastic support structure is constructed of a metal shell having a ceramic bearing shrink-fitted thereon and rubber mounted on the outer peripheral portion of the metal shell. In order to hold the axis of the ceramic bearing and the axis of a rolling bearing provided outside a pump casing horizontally, an elastic support structure of high rigidity is employed. In the beginning after assembling, hard rubber is hardly deformed to hold the axes horizontally and hence avoids local contact and provides stable sliding characteristics.

Further, one of bearings for vertical drainage pumps is a ceramic bearing as disclosed in Japanese Patent Laid-Open No. H6(1994)-147228 (Patent document 2). In this ceramic bearing, a spherical pivot is formed on the outer peripheral side of a metal case so as to avoid the local contact of a ceramic pad bearing fixed to the metal case and a metal ring is arranged on the outer peripheral side of the pivot and hard rubber is mounted on the metal ring in such a way as to surround the metal ring. This construction can prevent the ceramic pad bearing from being damaged by the local contact.

Still further, one of horizontal drainage pumps, as disclosed in Japanese Patent Laid-Open No. H6(1994)-346887 (Patent document 3), uses a sliding bearing of an oil lubrication type using a white metal as a bearing. This sliding bearing does not employ an elastic support structure, which is different from the ceramic bearing, and hence can hold an axis horizontally even if it is operated for a long period of time and can avoid damage caused by local contact.

On the other hand, one of sliding bearings having a sliding surface including a hard member and a soft member used for a diesel engine, a turbine, and the like is disclosed in Japanese Patent Laid-Open No. H10(1988)-252758 (Patent document 4). According to this patent document 4, in a sliding bearing having a sliding surface including hard members and soft members which are alternately arranged, the hard members and the soft members are arranged on the slant in a sliding direction. This construction can surely pass foreign matters in a lubricating oil moving along the sliding direction over the soft members arranged on the slant in the sliding direction even if the hard members are enlarged in width so as to have a necessary loading capacity. Hence, this construction can surely embed these foreign matters in the soft members, thereby providing the sliding bearing with a sufficient loading capacity and enhancing the ability of making the foreign matters in the lubricating oil embedded in the soft members to prevent the sliding bearing from being burnt.

Furthermore, one of sliding bearings used as bearings for an internal combustion engine such as automobile, ship, agriculture machine, and construction machine is disclosed in Japanese Patent Laid-Open No. 2002-147459 (Patent document 5). This sliding bearing includes a backing metal layer, a bearing alloy layer provided over the backing metal layer, and an overlay layer that is laminated over the bearing alloy layer and becomes a surface layer, wherein fine crater-shaped depressed portions are formed on the overlay surface and hard particles are sprayed onto the surface of the overlay layer. These depressions provide the surface with an oil storing function to increase the thickness of an oil film produced during operation to produce stable sliding characteristics.

However, the patent documents 1, 2 disclose that the local contact of the ceramic bearing is prevented but do not disclose that the bearing is damaged by hard particles mixed in pumped water used as a lubricant. In the bearings disclosed in the patent documents 1, 2, in a case where hard particles are mixed in the pumped water used as a lubricant, there is a possibility that the bearing part might be damaged by the hard particles.

Further, in the bearings disclosed in the patent documents 3 to 5, oil-lubricated bearing is used, which is different from the sliding bearing using pumped water as a lubricant for the bearing. This type of bearing has a problem that, in order to surely prevent oil from flowing outside the bearing, a seal structure of high reliability is indispensably required to increase the cost of a bearing unit. Still further, from a viewpoint of keeping a stable bearing function, oil to be used is required to have deterioration conditions checked on a regular basis. Hence, it cannot be said that this type of bearing gives sufficient consideration to maintenance-free performance.

The present invention has been made in view of these circumstances. The object of the invention is to provide a drainage pump and an underwater bearing unit that can enhance wear resistance to hard particles mixed in pumped water and prevent abrasive wear while providing maintenance-free performance by using the pumped water as a lubricant of a sliding bearing.

SUMMARY OF THE INVENTION

In order to achieve the above object, according to the present invention, there is provided a drainage pump including a pump part in which blades fixed to a rotary shaft are arranged in a pump casing and an underwater bearing unit which uses pumped water mixed with hard particles as a lubricant and has a sliding bearing for journaling the rotary shaft; and characterized in that a portion of the rotary shaft journaled by the sliding bearing is formed of a cemented carbide alloy material and that a shaft journaling surface of the sliding bearing is formed of a thermoplastic resin material to be embedded with the hard particles.

In order to achieve the above object, according to the present invention, there is provided a drainage pump comprising a pump part in which blades fixed to a rotary shaft are arranged in a pump casing and an underwater bearing unit which uses pumped water mixed with hard particles as a lubricant and has a sliding bearing for journaling the rotary shaft; and characterized in that a portion of the rotary shaft journaled by the sliding bearing is formed of a cemented carbide alloy material and that a shaft journaling surface of the sliding bearing is formed of a thermoplastic resin material combined with hard particles.

In the above-described inventions, it is preferable to employ the following constructions.

(1) A thermoplastic resin material not containing fibers is used as the thermoplastic resin material formed on the shaft journaling surface of the sliding bearing.

(2) A ring-shaped member for narrowing an opening of inflow side of pumped water of the sliding bearing is provided.

(3) The rotary shaft and the sliding bearing are horizontally arranged to make a horizontal pump part and a horizontal sliding bearing. The sliding bearing is arranged in such a way that an upper gap between sliding portions of the sliding bearing and the rotary shaft is wide and a lower gap between the sliding portions is narrower than the upper gap. The ring-shaped member is placed on the rotary shaft in such a way that an upper opening between the ring-shaped member and the rotary shaft is narrow and a lower opening between them is wider than the upper opening and is narrower than the upper gap between the sliding portions.

(4) A surface of the portion of the rotary shaft journaled by the sliding bearing is formed of a cemented carbide alloy film.

(5) A sleeve made of a cemented carbide alloy having corrosion resistance is put onto the portion of the rotary shaft journaled by the sliding bearing from one side end of the rotary shaft.

(6) A sleeve having at least its surface made of a cemented carbide alloy material is put onto the rotary shaft from one side end of the rotary shaft. A positioning member for holding the sleeve made of the cemented carbide alloy material is removably mounted on the one side end of the rotary shaft.

Further, in order to achieve the above-described object, according to the invention, there is provided an underwater bearing unit in which pumped water mixed with hard particles is used as a lubricant and in which a sliding bearing for journaling a rotary shaft is provided; and characterized in that a portion of the rotary shaft journaled by the sliding bearing is formed of a cemented carbide alloy material and that a shaft journaling surface of the sliding bearing is formed of a resin material to be embedded with hard particles.

Further, in order to achieve the above-described object, according to the invention, there is provided an underwater bearing unit in which pumped water mixed with hard particles is used as a lubricant and in which a sliding bearing for journaling a rotary shaft is provided; and characterized in that a portion of the rotary shaft journaled by the sliding bearing is formed of a cemented carbide alloy material and that a shaft journaling surface of the sliding bearing is formed of a resin material combined with hard particles.

According to the invention, pumped water mixed with hard particles is used as a lubricant and a portion of a rotary shaft journaled by the sliding bearing is formed of a cemented carbide alloy material and a shaft journaling surface of the sliding bearing is formed of a thermoplastic resin material to be embedded with the hard particles. Hence, it is possible to provide a drainage pump and an underwater bearing unit employing a sliding bearing that can provide maintenance-free performance and enhance wear resistance to hard particles mixed in the pumped water and prevent abrasive wear and avoid the occurrence of cracks and damages caused by heat shock.

That is, the use of the pumped water as the lubricant of the sliding bearing, like a conventional oil-lubricated bearing, can make the sliding bearing maintenance-free and can eliminate the need for checking the deterioration conditions of oil. Further, since the hard particles are easily embedded in the sliding surface of the bearing to protect the sliding surface by the embedded hard particles, the wear resistance of the thermoplastic resin material can be enhanced to a great extent to provide stable sliding characteristics for a long period of time. Still further, since floating hard particles easily slide and flow on the sliding surface of the bearing in which the hard particles are embedded, the sliding surface of the bearing can be prevented from being abrasively worn. Still further, since the thermoplastic resin material is used, even if a break in a water film is locally caused by the local contact of the sliding surface of the bearing with the main shaft of the pump, the sliding surface is softened to be easily fluidized to be smoothed, thereby being stabilized in a state of being conformed to the main shaft of the pump, which can avoid the occurrence of cracks and damages caused by heat shock.

Further, according to the invention, pumped water mixed with hard particles is used as a lubricant and a portion a rotary shaft journaled by the sliding bearing of is formed of a cemented carbide alloy material and a shaft journaling surface of the sliding bearing is formed of a thermoplastic resin material combined with hard particles. Hence, it is possible to provide a drainage pump and an underwater bearing unit employing a sliding bearing that uses the pumped water as the lubricant and can provide maintenance-free performance and enhance wear resistance to the hard particles mixed in the pumped water and prevent abrasive wear.

That is, the use of the pumped water as the lubricant of the sliding bearing, like a conventional oil-lubricated bearing, can eliminate the need for checking the deterioration conditions of oil and can make the sliding bearing maintenance-free. Further, since the shaft journaling surface of the sliding bearing is formed of the thermoplastic resin material combined with hard particles, the combined hard particles can enhance wear resistance of the thermoplastic resin material to a great extent and provide stable slidability for a long period of time. Still further, since floating hard particles easily slide and flow on the sliding surface of the bearing which is combined with the hard particles, the sliding surface of the bearing can be prevented from being abrasively worn. Still further, since the thermoplastic resin material is used, even if a break in a water film is locally caused by the local contact of the sliding surface of the bearing with the main shaft of the pump, the sliding surface is softened to be easily fluidized to be smoothed, thereby being stabilized in a state of being conformed to the main shaft of the pump, which can avoid the occurrence of cracks and damages caused by heat shock.

According to above-described preferable construction of the invention, the thermoplastic resin material not containing fibers is used as the thermoplastic resin material for forming the shaft journaling surface of the sliding bearing, so the thermoplastic resin material not containing fibers can prevent the shaft journaling surface of the sliding bearing from being cut and worn by worn powder produced by broken and dropped fibers caused by hard particles flowed to and pressed in the bearing part. Here, in a case where the shaft journaling surface of the sliding bearing is formed of the resin material to be embedded with the hard particles, the fibers are not broken and dropped and hence the hard particles can be easily embedded in the sliding surface of the bearing. The embedded hard particles can enhance the wear resistance of the thermoplastic resin material not containing the fibers to a great extent and can further prevent the sliding surface of the bearing from being abrasively worn.

According to above-described preferable construction of the invention, a ring-shaped member for narrowing an opening of inflow side of pumped water of the sliding bearing is provided, so the ring-shaped member can prevent large foreign matters mixed in the pumped water from entering the sliding portion of the bearing and hence can improve reliability.

In particular, the rotary shaft and the sliding bearing are horizontally arranged to make a horizontal pump part and a horizontal sliding bearing and the sliding bearing is arranged in such a way that an upper gap between sliding portions of the sliding bearing and the rotary shaft is wide and a lower gap between the sliding portions is narrower than the upper gap. Further, the ring-shaped member is placed on the rotary shaft in such a way that an upper opening between the ring-shaped member and the rotary shaft is narrow and a lower opening between them is wider than the upper opening and is narrower than the upper gap between the sliding portions. Therefore, large foreign matters can be prevented from entering the gap between the sliding portions by simple structure.

According to above-described preferable construction of the invention, the surface of the portion of the rotary shaft journaled by the sliding bearing is formed of a cemented carbide alloy film, so a portion of the rotary shaft opposite to the sliding bearing can be formed of a cemented carbide alloy material.

According to above-described preferable construction of the invention, a sleeve made of the cemented carbide alloy having corrosion resistance is put onto the portion of the rotary shaft journaled by the sliding bearing, so a portion of the rotary shaft opposite to the sliding bearing can be simply formed of the cemented carbide alloy material only by mounting the sleeve separately manufactured of the cemented carbide alloy on the rotary shaft.

According to above-described preferable construction of the invention, a sleeve made of a cemented carbide alloy material is put onto the rotary shaft from one side end of the rotary shaft and a positioning member for holding the sleeve made of the cemented carbide alloy material is removably mounted on the one side end of the rotary shaft. Hence, in case of the sleeve made of the cemented carbide alloy material being damaged, the positioning member is removed and the sleeve made of the cemented carbide alloy material can be replaced. Therefore, reliability can be improved.

DETAILED DESCRIPTION OF THE PREFERRED EMBODIMENTS

Figure 1:
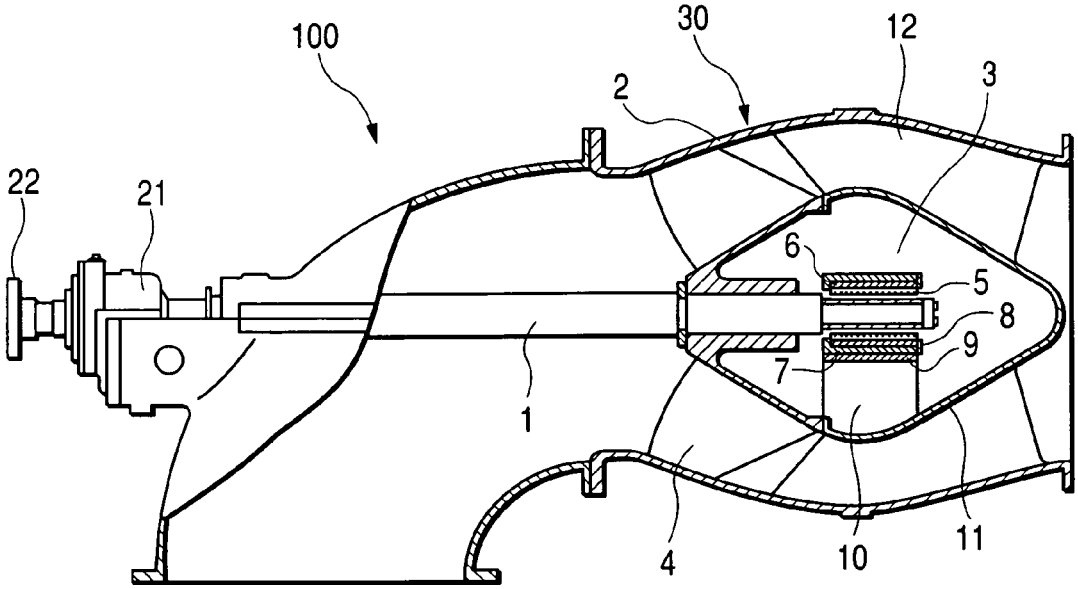
FIG. 1 is a longitudinal cross-sectional view of a horizontal drainage pump in accordance with the first embodiment of the present invention.

Hereafter, a plurality of embodiments of the present invention will be described by use of drawings. In the second embodiment and the following embodiments, a duplicate description of construction common to the first embodiment will be omitted. In this regard, like reference symbols in the drawings of the respective embodiments designate like or corresponding parts. While a case where a PTFE base thermoplastic resin is used as a resin material of a bearing part will be described here, there is no limit to the kind of a material if the material is a thermoplastic resin material.

First, the first embodiment of the present invention will be described by use of FIG. 1 to FIG. 3. FIG. 1 is a longitudinal cross-sectional view of a horizontal drainage pump in accordance with the first embodiment of the invention and FIG. 2 is an enlarged view of a main portion in FIG. 1.

A horizontal drainage pump 100, as shown in FIG. 1, is constructed of a pump part 30, an underwater bearing unit 3, and a rolling bearing unit 21.

The pump part 30 is mainly formed of a main shaft 1, blades 4 mounted on one side end of the main shaft 1, and a pump casing 2, wherein the main shaft 1 and the blades 4 are arranged in the pump casing 2. The pump casing 2 is formed in such a way as to pump water from the bottom side of one side and to discharge the pumped water in a horizontal direction on the other side. This pumped water is pumped from ground water and hence has hard particles or the like of foreign matters mixed therein. In the main shaft 1, its one side end is journaled by the underwater bearing unit 3 in the pump casing 2 and its other side end extends through the pump casing 2 to the outside and is journaled outside the pump casing 2 by the rolling bearing unit 21. The main shaft 1 is coupled to a motor (not shown) via a coupling 22 and is driven by this motor.

Figure 2:
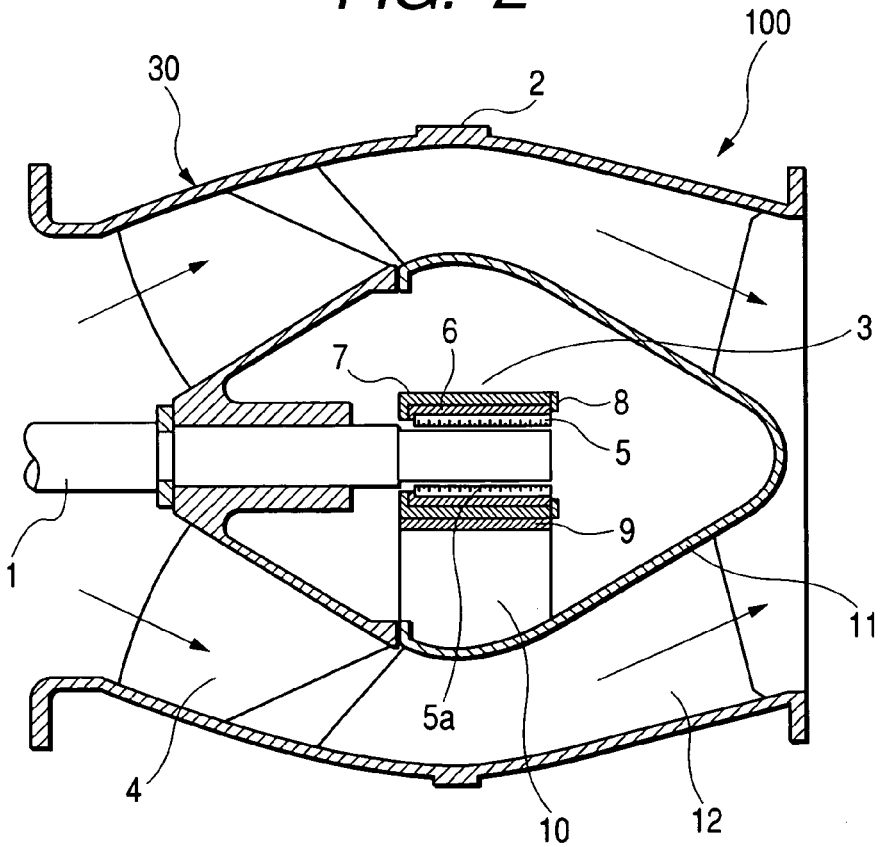
FIG. 2 is an enlarged view of a main portion in FIG. 1.
Figure 3:
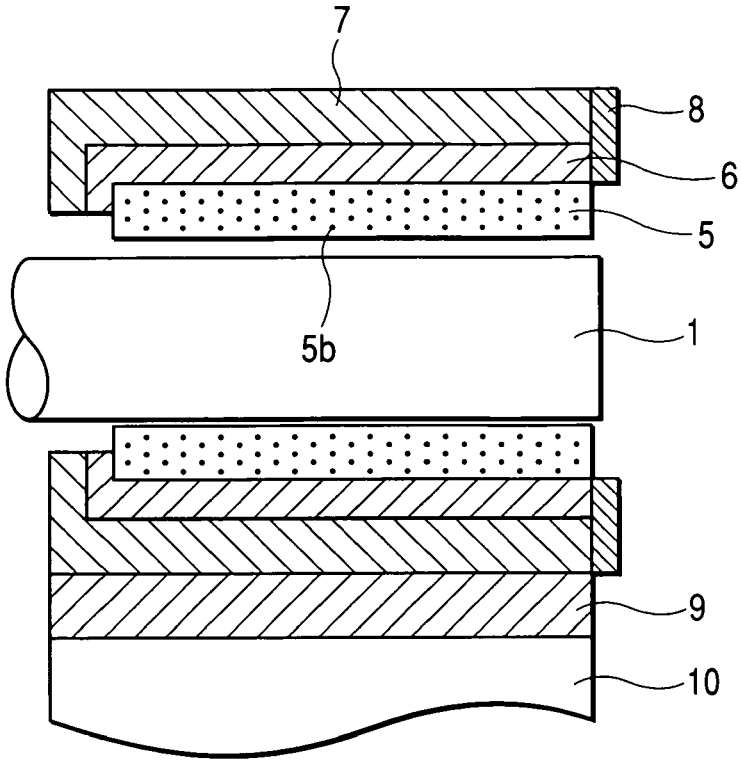
FIG. 3 is a cross-sectional view to show a portion of an underwater bearing unit of a horizontal drainage pump in accordance with the second embodiment of the present invention.

The underwater bearing unit 3, as shown in FIG. 2, is provided in a pumped water path of the drainage pump 100 and uses the pumped water mixed with the hard particles as a lubricant for the bearing. Here, a sliding bearing 5 shown in FIG. 2 shows a state where the hard particles 5*a* mixed in the pumped water are embedded in the sliding bearing 5 and, as shown in FIG. 2, the hard particles 5*a* are embedded in the surface side of the sliding bearing 5. An arrow in FIG. 2 designates a direction of flow of the pumped water.

The underwater bearing unit 3 is constructed of the sliding bearing 5 mounted on a bearing part and made of a thermoplastic synthetic resin not containing fibers, a backing metal 6 into which this sliding bearing 5 is fixedly pressed, a bearing case 7 mounted with this backing metal 6, a support 9 for fixing this bearing case 7, and a support sustainer 10 for sustaining this support 9. The support sustainer 10 is fixed to a bearing casing 11. The bearing casing 11 is fixed to the pump casing 2 via ribs 12. A plate 8 is provided so as to prevent the backing metal 6 mounted in the bearing case 7 from being withdrawn.

A portion of the main shaft 1 journaled by the sliding bearing 5 is formed of a cemented carbide alloy material. As for the portion formed of the cemented carbide alloy material, to be more specific, the surface of the portion of the main shaft 1 journaled by the sliding bearing 5 is coated with a cemented carbide alloy film.

Next, the function and operation of the drainage pump 100 and the underwater bearing unit 3 having the above-described construction will be described.

The drainage pump 100 has the pump casing 2 filled with pumped water mixed with the hard particles and then is driven to start draining water. Hence, the underwater bearing unit 3 is used in a state where it is submerged in water and the pumped water is used as a lubricating material. Therefore, in the underwater bearing unit 3, like a conventional oil-lubricated bearing, the checking of the deterioration conditions of oil is not required. Hence, the underwater bearing unit 3 can be made free of maintenance.

The underwater bearing unit 3 has the sliding bearing housing a PTFE base resin material of a thermoplastic resin material not containing fibers in the bearing part. It is checked that when this material slides in a state where it is lubricated with water, a coefficient of friction is as small as about 0.004 and hardly varies but is stable even if the sliding bearing 5 is used for a long time of operation.

When a pumping operation is started, the pumped water mixed with the hard particles flows into a sliding part gap constructed of the sliding surface of the sliding bearing 5 and the main shaft 1. The hard particles are drawn in a peripheral direction of the sliding surface with the rotation of the main shaft 1. The sliding part gap constructed of the sliding surface of the sliding bearing 5 and the main shaft 1 is formed in the shape of a wedge in a rotational direction and a hydraulic pressure equal to bearing load is generated in this wedge-shaped portion. For this reason, the hard particles flowing into the bearing part slide on the sliding surface of the sliding bearing 5 and reach a region where the hydraulic pressure is generated and then are subjected to an action force caused by the hydraulic force, thereby being embedded in the sliding surface of the sliding bearing 5.

Since the sliding surface of the sliding bearing 5 is constructed of the thermoplastic resin material not containing fibers, the sliding surface can be prevented from being cut and worn by wearing powder produced by the fibers broken and dropped by the pressed-in hard particles. Moreover, the fibers are not broken and dropped, the hard particles can be easily embedded in the sliding surface of the sliding bearing 5. Since the sliding surface of the sliding bearing 5 is protected by the embedded hard particles, the wear resistance of the thermoplastic resin material not containing fibers is enhanced to a great extent. After the sliding surface of the sliding bearing 5 is covered with the hard particles, the floating hard particles easily slide and flow on the sliding surface of the bearing in which the hard particles are embedded and hence the sliding surface of the bearing can be prevented from being abrasively worn. As a result, the sliding bearing 5 can be prevented from being rapidly worn by the hard particles and to ensure sufficient wear resistance and hence can have stable sliding characteristics for a long period of time.

Further, since the sliding bearing 5 does not have such an elastic support structure of rubber that is used in a conventional bearing but has a rigid support structure, its bearing part can be prevented from being sunk. Still further, since the sliding bearing 5 made of the thermoplastic resin is used, even if a water film is broken by the local contact of the pump main shaft 1 with the sliding surface such as one side contact, the sliding surface at the local contact point is softened and easily fluidized to be made smooth. Hence, the sliding bearing 5 is stabilized in a state of conforming to the pump main shaft 1 and can avoid the occurrence of cracks and damages caused by heat shock.

The above-described construction of the drainage pump 100 and the underwater bearing unit 3 can prevent the sliding surface of the bearing from being worn and damaged by the hard particles even for a long period of drainage operation and can enhance wear resistance to a great extent and hence can ensure stable sliding characteristics. Therefore, this can provide the drainage pump 100 and the underwater bearing unit 3 of high reliability.

In order to check an effect of using the thermoplastic resin material 5 not containing the fibers for the sliding bearing 5, sliding element tests of a combination of a ring-shaped rotary side test piece and a ring-shaped stationary side test piece were performed for various kinds of resin materials to check the damage conditions of the sliding surface. Operation conditions were as follows: six radiant grooves for water lubrication were formed on the stationary test piece and lubricating water mixed with hard particles (concentration of mixed silica sand: 3000 ppm, hard particles: silica sand) was introduced into the grooves; and the rotary side test piece was rotated at constant conditions of an average peripheral speed 5 m/sec and an average surface pressure (test load/sliding area) 1 MPa while the sliding surface was being lubricated with the water mixed with the hard particles. The sliding element tests were performed for two hours under the above operation conditions.

Results of this sliding element tests are shown in Table 1. This table 1 shows a combination of materials and the conditions of the sliding surface after the tests.

TABLE 1

| Test piece No. | Rotary side test piece | Stationary side test piece | Observation result of sliding surface after test: Rotary side | Observation result of sliding surface after test: Stationary side |
|---|---|---|---|---|
| 1. Present invention | Cemented carbide alloy film | Resin material to be embedded with hard particles (PTFE base) | No wear damage | No wear damage (hard particles are embedded in sliding surface) |
| 2. Present invention | Cemented carbide alloy film | Resin material combined with hard particles | No wear damage | Slight scratch |
| 3. Comparative example | Cemented carbide alloy film | PEEK resin containing carbon fibers | No wear damage | Deep streaky scratch in circumferential direction |

As is evident from No. 1 in Table 1, it was checked that in a combination of the thermoplastic resin material not containing fibers and the cemented carbide alloy film, no wear damage was caused on the sliding surface of the stationary test piece in the lubrication by water mixed with the hard particles and that the hard particles were embedded in the sliding surface. Hence, it was found that wear resistance was enhanced.

In contrast to this, a PEEK resin shown in No. 3 in Table 1 and to be little embedded with the hard particles and containing carbon fibers was cut and worn by worn powder produced by broken and dropped fibers caused by the hard particles flowing to and pressed into the sliding surface to show signs of abrasive wear and had streaky scratches observed in a circumferential direction. Furthermore, since wear damage caused by the broken and dropped fibers progressed, the sliding surface of the bearing was repeatedly born and dropped and hence the hard particles were not easily embedded in the sliding surface and, as a result, it was found that the hard particles were not embedded in the sliding surface after the test.

From the results of the sliding element tests, it was examined by experiments that the hard particles embedded in the sliding surface of the sliding bearing 5 protected the sliding surface of the sliding bearing 5 and hence enhanced wear resistance to a great extent. Here, the cemented carbide alloy film used for the rotary side test piece was a nickel binder base cemented carbide alloy material having corrosion resistance and wear damage was not observed in the cemented carbide alloy film.

Next, the second embodiment of the invention will be described with reference to FIG. 3. FIG. 3 is a cross sectional view to show a portion of the underwater bearing unit of the drainage pump in accordance with the second embodiment of the invention. This second embodiment is different in the following point from the first embodiment and is fundamentally equal in the other points to the first embodiment.

In this embodiment, the sliding bearing 5 is constructed of the thermoplastic resin material combined with silicon carbide particles 5*b* and not containing fibers. The silicon carbide particle 5*b* is hard ceramic and shows excellent wear resistance. For this reason, in the silicon carbide particles exposed to the sliding surface of the sliding bearing 5, wear hardly progresses even in the drainage operation. As a result, the sliding surface of the sliding bearing 5 is protected to provide stable sliding characteristics for a long period of time. Furthermore, since it is known that the silicon carbide particles adsorb water to produce hydrate in the form of gel on the sliding surface, the silicon carbide particles enhance lubrication performance and can respond to high bearing pressure and hence can provide a resin bearing of a long life.

Furthermore, as is evident from No. 2 in Table 1, it was found that a combination of the thermoplastic resin material combined with the silicon carbide particles and the cemented carbide alloy film had no wear damage and had wear resistance in lubrication by water mixed with the hard particles though slight scratches were observed on the sliding surface of the stationary side test piece.

Figure 4:
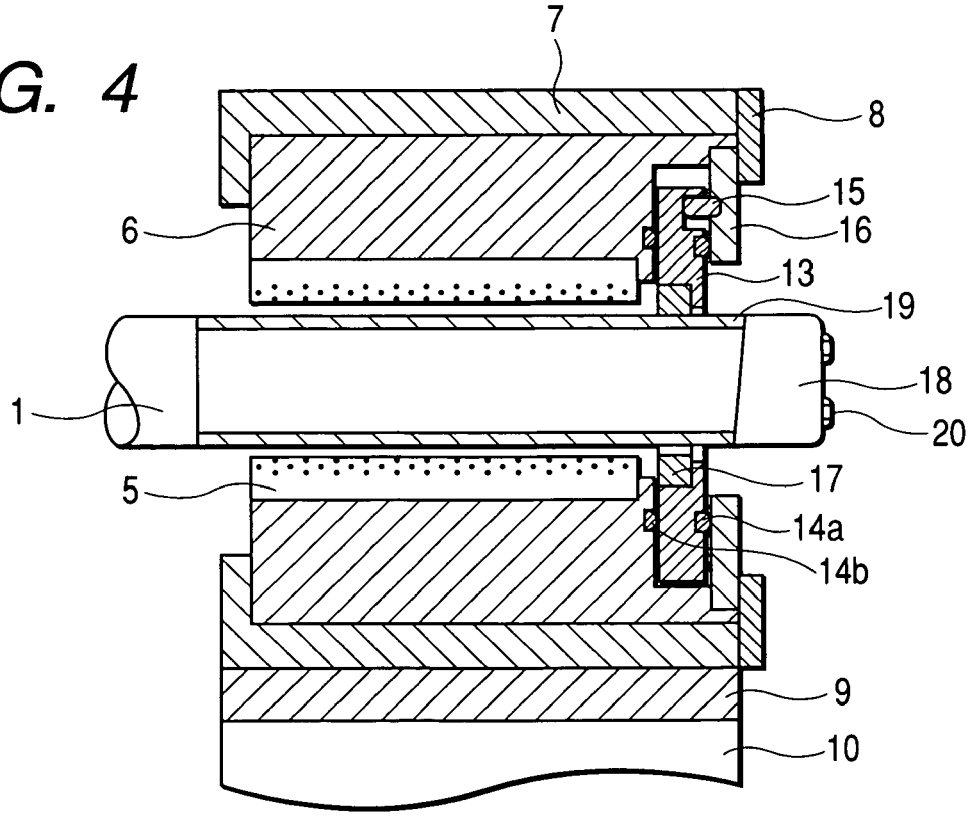
FIG. 4 is a cross-sectional view to show a portion of an underwater bearing unit of a horizontal drainage pump in accordance with the third embodiment of the present invention.

Next, the third embodiment of the invention will be described with reference to FIG. 4. FIG. 4 is a cross sectional view to show a portion of the underwater bearing unit of the drainage pump in accordance with the invention. This third embodiment is different in the following point from the first embodiment and is fundamentally equal in the other points to the first embodiment.

In this third embodiment, a ring-shaped member 17 is provided near one end of the sliding bearing 5. The underwater bearing unit 3 is constructed of a thermoplastic sliding bearing 5 mounted in the bearing part and not containing fibers, the backing metal 6 having the sliding bearing 5 fixedly pressed thereinto, the support 9 for fixedly positioning the bearing case 7 mounted with the backing metal 6 at the support sustainer 10, and the ring-shaped member 17 provided near one end of the bearing part.

The ring-shaped member 17 is fixed in a metal case 13 by shrink fit. The metal case 13 is elastically supported between the backing metal 6 and a side plate 16 by rubber rings 14*a*, 14*b* provided on both end surfaces thereof. That is, the rubber rings 14*a*, 14*b* are positioned in an axial direction by the backing metal 6 and the side plate 16. Hence, the ring-shaped member 17 is elastically supported between the backing metal 6 and the side plate 16 via the rubber rings 14*a*, 14*b*. A rotation preventing pin 15 is provided on the outer peripheral side of the metal case 13 to prevent the metal case 13 from being rotated with the rotation of the ring-shaped member 17. The material of the ring-shaped member 17 is ceramics and silicon nitride is preferable among the ceramics.

The ring-shaped member 17 is provided so as to narrow the opening of inflow side of pumped water of the sliding bearing 5. To be more specific, the ring-shaped member 17 is constructed so as to narrow the opening of inflow side of pumped water along with the metal case 13 and the rubber rings 14*a*, 14*b*. In this case, the ring-shaped member 17 may be integrally formed with the metal case 13.

Furthermore, the ring-shaped member 17 is placed on the main shaft 1 in such a way that an upper opening between the ring-shaped member 17 and the main shaft 1 is narrow and that a lower opening between them is wider than the upper opening. On the other hand, the main shaft 1 is placed on the sliding bearing 5 in such a way that an upper gap between sliding portions of the sliding bearing 5 and the main shaft 1 is wide and a lower gap between them is narrower than the upper gap. The upper opening between the ring-shaped member 17 and the main shaft 1 is set narrower than the upper gap between the sliding bearing 5 and the main shaft 1.

In the underwater bearing unit 3 of this construction, when the pumped water mixed with the hard particles is drained, the pumped water passes through the gap between the ring-shaped member 17 and the main shaft 1 and then flows to the sliding surface of the sliding bearing 5. An anti-load side gap between the ring-shaped member 17 and the main shaft 1 is smaller than an anti-load side gap between the sliding bearing 5 and the main shaft 1 because the ring-shaped member 17 is dropped in a direction of gravity. Further, the diameters of the hard particles flowing to the sliding surface of the resin bearing can be also reduced as compared with a case where the ring-shaped member 17 is not provided.

For this reason, the hard particles can be easily embedded in the sliding bearing 5 to enhance a function of protecting the sliding surface of the sliding bearing 5 as compared with a case where a function of limiting the sizes of hard particles biting in the sliding surface of the bearing is not provided. Moreover, since the sizes of the hard particles flowing to the sliding surface of the bearing are reduced, the hard particles can easily slide on the embedded hard particles to reduce frictional loss. Hence, wear hardly progresses and the sliding bearing 5 has its life elongated.

Furthermore, in this embodiment, a sleeve 19 made of a cemented carbide alloy having corrosion resistance is mounted on the main shaft 1 side opposite to the thermoplastic sliding bearing 5 not containing fibers and the ring-shaped member 17. The sleeve 19 is fixed to the main shaft 1 by bolts 20 via a positioning ring 18 mounted on the right side. The sleeve 19 made of the cemented carbide alloy may be constructed of a ring made of SUS 304 with its surface overlaid with a cemented carbide alloy film having corrosion resistance. In this regard, the material of the cemented carbide alloy having corrosion resistance is a WC—Ni base or WC—Ti base cemented carbide alloy. Needless to say, this construction can produce equivalent effects. Moreover, this embodiment can produce the following special effect.

In case of the sleeve 19 being damaged on the surface, replacing the sleeve 19 is all that is required to do and hence replacement cost can be reduced as compared with a case where the main shaft 1 is replaced. Further, since the cemented carbide alloy having corrosion resistance is used for the sleeve 19, the sliding surface of the sleeve 19 is hard to suffer rough surface damage caused by corrosion and can keep wear resistance for a long period of time. Still further, since the sleeve 19 has high hardness, the sleeve 19 is hard to suffer surface deformation caused by a water film pressure and hence can enhance also resistance to load. Still further, the use of a combination of the cemented carbide alloy and the resin to be embedded with the hard particles provides excellent conformability and hence reduces roughness on the sleeve and the sliding surface of the bearing to make them smooth. Therefore, stable wear characteristics can be provided from the beginning of operation.

Furthermore, since a surface opposite to the ring-shaped member 17 has hardness higher than the hard particles, the surface is hard to suffer damage caused by the hard particles and can prevent a gap from being increased with progress in wear, which can limit the sizes of hard particles to a predetermined value or less. As a result, the sizes of the hard particles flowing to the sliding surface of the bearing are made smaller than the bearing gap to keep a particle-embedding function stably. After the hard particles are embedded in the sliding surface of the bearing, the new flowing-in hard particles flow over the embedded hard particles and are discharged outside. Hence, the sliding surface can avoid wear damage.

In addition, the use of a construction capable of limiting the sizes of the flowing-in hard particles to an initial bearing diameter gap or less by the ring-shaped member 17 provided near the one end of the bearing made of thermoplastic resin not containing fibers slightly increases the bearing diameter gap at the beginning of operation but makes the hard particles easily pass on the sliding surface of the bearing and hence wear hardly progresses on the sliding surface. Here, the inside diameter of the resin bearing is nearly equal to the inside diameter of the ring-shaped member, but if the inside diameter of the ring-shaped member is smaller than the inside diameter of the resin bearing, foreign matters having diameters smaller than the bearing diameter gap enter the resin bearing from the beginning of operation. Hence the hard particles can be easily embedded in the sliding surface of the resin bearing and wear hardly progresses and hence the sliding bearing has its life elongated.

What is claimed is:

1. A drainage pump comprising a pump part in which blades fixed to a rotary shaft are arranged in a pump casing and an underwater bearing unit which uses pumped water mixed with hard particles as a lubricant and has a sliding bearing for journaling the rotary shaft, wherein a portion of the rotary shaft journaled by the sliding bearing is formed of a cemented carbide alloy material and a shaft journaling surface of the sliding bearing is formed of a thermoplastic resin material to be embedded with the hard particles, further comprising a ring-shaped member for narrowing an opening of inflow side of pumped water of the sliding bearing.

2. The drainage pump as claimed in claim 1, wherein the rotary shaft and the sliding bearing are horizontally arranged to make a horizontal pump part and a horizontal sliding bearing, wherein the sliding bearing is arranged in such a way that an upper gap between sliding portions of the sliding bearing and the rotary shaft is wide and a lower gap between the sliding portions is narrower than the upper gap, and the ring-shaped member is placed on the rotary shaft in such a way that an upper opening between the ring-shaped member and the rotary shaft is narrow and that a lower opening between them is wider than the upper opening and is narrower than the upper gap between the sliding portions.

* * * * *